United States Patent [19]

Frisch

[11] Patent Number: 4,851,858

[45] Date of Patent: Jul. 25, 1989

[54] REFLECTOR ANTENNA FOR OPERATION IN MORE THAN ONE FREQUENCY BAND

[75] Inventor: Eberhard Frisch, Unterhaching, Fed. Rep. of Germany

[73] Assignee: Messerschmitt-Boelkow-Blohm GmbH, Munich, Fed. Rep. of Germany

[21] Appl. No.: 693,616

[22] Filed: Jan. 22, 1985

[30] Foreign Application Priority Data

Jan. 26, 1984 [DE] Fed. Rep. of Germany ..... 3402659

[51] Int. Cl.[4] ..... H01Q 15/14

[52] U.S. Cl. ..... 343/779; 343/909

[58] Field of Search ..... 343/756, 781 P, 840, 343/909, 779, 781 R

[56] References Cited

U.S. PATENT DOCUMENTS

| | | | |
|---|---|---|---|
| 2,636,125 | 4/1953 | Southworth | 343/909 |
| 2,870,444 | 1/1959 | Broussaud | 343/914 |
| 2,884,630 | 4/1959 | Robinson | 343/914 |
| 3,096,519 | 7/1963 | Martin | 343/914 |
| 3,231,892 | 1/1966 | Matson et al. | 343/909 |
| 3,842,421 | 10/1974 | Rootsey et al. | 343/909 |
| 3,898,667 | 8/1975 | Raab | 343/756 |
| 3,924,239 | 12/1975 | Fletcher et al. | 343/909 |
| 4,388,388 | 6/1983 | Kornbau et al. | 343/909 |
| 4,479,131 | 10/1984 | Rogers et al. | 343/909 |
| 4,550,319 | 10/1985 | Ganssle et al. | 343/DIG. 2 |

FOREIGN PATENT DOCUMENTS

| | | | |
|---|---|---|---|
| 2610506 | 3/1982 | Fed. Rep. of Germany . | |
| 2281660 | 8/1974 | France | 343/909 |
| 2349968 | 11/1977 | France | 343/909 |

OTHER PUBLICATIONS

Arnaud et al., Resonant-Grid Quasioptical Diplexer, Electronic Letters, Dec. 13, 1973, No. 25, pp. 589, 590.

*Primary Examiner*—Rolf Hill
*Assistant Examiner*—Michael C. Wimer
*Attorney, Agent, or Firm*—W. G. Fasse; D. H. Kane, Jr.

[57] ABSTRACT

A reflector antenna is constructed for operation in at least two frequency ranges. For this purpose the concave surface of the antenna reflector body, which preferably has a paraboloid configuration, is provided with surface zones arranged in regular arrays or patterns. These surface zones provide antenna or reflector elements which are reflecting or transparent with regard to a particular frequency range or band width, while other surface zones of the antenna reflector surface are transparent or reflecting in another given frequency range or band widths. Thus, depending on the configurations and dimensions of these different surface zones one and the same antenna is capable of handling frequencies in a plurality of different band widths and different apertures.

13 Claims, 3 Drawing Sheets

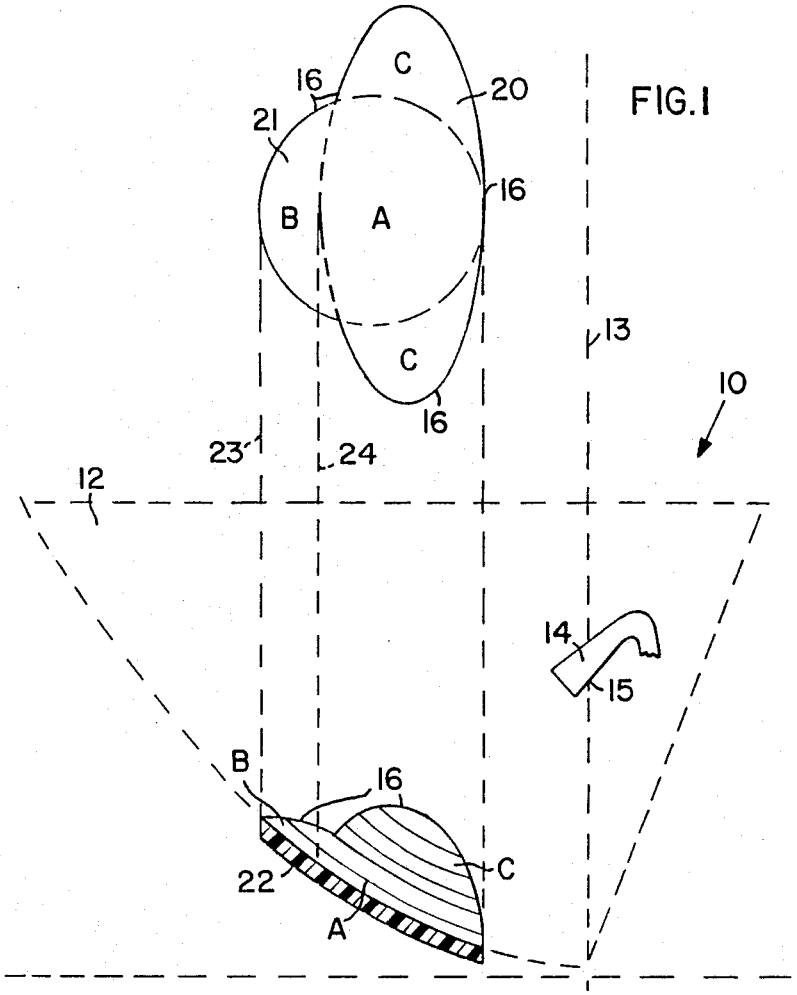
FIG.8
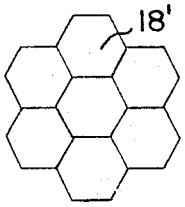
FIG.2
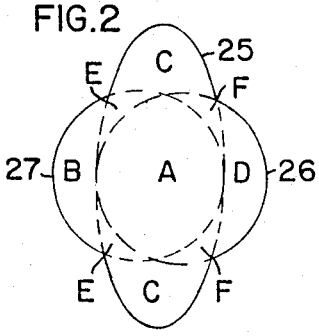

REFLECTOR ANTENNA FOR OPERATION IN MORE THAN ONE FREQUENCY BAND

FIELD OF THE INVENTION

The invention relates to a reflector antenna for operation in two or more frequency bands. Such antennas have a vaulted reflector cooperating with one or more antenna feeding elements.

DESCRIPTION OF THE PRIOR ART

German Patent Publication (DE-PS) No. 2,610,506 discloses a reflector antenna which is constructed for operation in two different frequency bands. The reflector shall be able to radiate in both frequency ranges with respective radiation or directional lobes both having the same beam width. If the reflector dimensions are the same for both frequency bands, the directional lobe for the higher frequency band would have a smaller beam width. In order to avoid this, the reflector surface for the higher frequency band is reduced in size in the prior art reflector antenna. This size reduction is accomplished by covering the edge of the reflector with a ring shaped radiation absorbing means which constitutes for the higher frequency band a strong damping, but almost does not provide any damping at all for the lower frequency band. Thus, by properly selecting the absorption means and correctly dimensioning these absorption means it is possible that both radiation or directional lobes have the same beam width. Of course, such an antenna according to the prior art can also be constructed to have radiation or directional lobes with different beam widths, for example, if the ring shaped absorption means are selected to provide a preferred absorption of the lower frequencies.

The requirement to transmit and receive in two or more different frequency bands is, for example, to be satisfied by communication satellites. Additionally, such satellites are frequently required to provide for the transmission and reception directional lobes having different cross-sectional configurations. Thus, for example, an elliptical cross-sectional configuration may be provided for the transmission lobe and a circular cross-sectional configuration may be provided for the reception lobe. In order to satisfy all these requirements it has been customary heretofore to carry several reflectors each equipped with its own feed system. These reflectors, or rather their aperture, was then adapted to the required cross-sectional configuration of the radiation or directional lobe. Even where only two such reflectors, for example, an elliptical and a circular reflector, are to be installed, substantial problems may be encountered with regard to the physical placement of these reflectors in the front portion of the transporter rocket which has very limited space. Another substantial problem is encountered due to the fact that both reflectors must open up after they have been transported into the intended orbit and such opening of the reflectors out of the initially folded position must not result in a hindrance of one reflector by the other and vice versa. Additionally, the more reflectors are needed, the resulting weight increase cannot be ignored. Due to all of these reasons it is desirable to use but one reflector which permits an operation in different frequency bands with different respective apertures.

The antenna reflector according to the above mentioned German Patent Publication No. 2,610,506 satisfies these requirements, however, only to the extent that the two radiation lobes of the two different frequency ranges, which may be handled by the antenna, have the same cross-sectional configuration, whereby one cross-section is entirely encompassed within the other cross-section. Another disadvantage of this type of prior art antenna is seen in that substantial quantities of heat are generated in the absorption means where high radiating powers are involved. These heat quantities are generated due to the absorption of the radiation energy in one of the frequency band widths. Substantial problems can be caused due to this heat generation, especially if these antennas are to be used in outer space because the heat cannot be dissipated in the absence of an efficient convection. As a result, there is a danger that the reflector will be thermally deformed by the generated heat. Besides, the absorption means are not completely uneffective relative to the other frequency band width. Even a very small dielectric effect leads to a deterioration or impairment of the side lobe damping so that present day requirements to be met by communication satellite antennas cannot be satisfied by antennas as disclosed in said German Patent Publication No. 2,610,506. Reference is made in this connection to the CCIR standards.

OBJECTS OF THE INVENTION

In view of the foregoing it is the aim of the invention to achieve the following objects singly or in combination:

to provide a reflector antenna capable of transmitting and/or receiving in a plurality of different frequency band widths with different apertures;

to provide such an antenna with radiation or directional lobes or patterns having differently shaped cross-sectional areas;

to avoid the above mentioned heat generation and resulting thermal deformations.

SUMMARY OF THE INVENTION

The surface of the antenna reflector according to the invention is subdivided into a plurality of reflector surface zones for forming different at least partly overlapping areas for the individual, predetermined frequency band widths. At least one surface zone is reflecting relative to all given frequency ranges. At least one other surface zone is reflecting for the respective single or, if desired, several further frequency ranges while simultaneously being transparent for the other given frequency ranges, whereby the marginal or edge contour of the reflector results due to the mutual overlapping of the apertures. Stated differently, the single reflector shall have different areas for the different frequency band widths or ranges and these areas mutually overlap each other at least partially. The outer contour of the geometric superposition of the areas provides the edge contour of the reflector. The reflector surface is divided into several reflector surface zones for forming the areas. The configurations and dimensions of the surface zones and their position relative to one another are determined by the shape of the areas.

BRIEF FIGURE DESCRIPTION

In order that the invention may be clearly understood, it will now be described, by way of example, with reference to the accompanying drawings, wherein:

FIG. 1 is a side view, partially in section, of a parabolic so-called off-set reflector antenna having a single bowl-shaped, concave antenna body with an elliptical and a circular aperture for two different frequency band widths, shown partially in section, and broken away;

FIG. 2 illustrates schematically a plan view of a reflector having two laterally displaced circular apertures and an elliptical central aperture suitable for a total of three different frequency ranges;

Figure 3A:
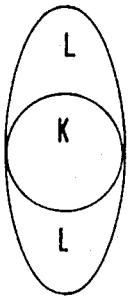
Figure 3B:
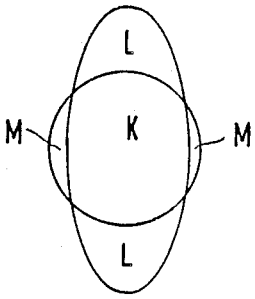
Figure 4A:
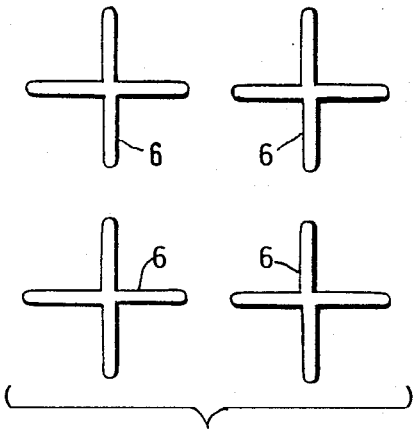
Figure 4B:
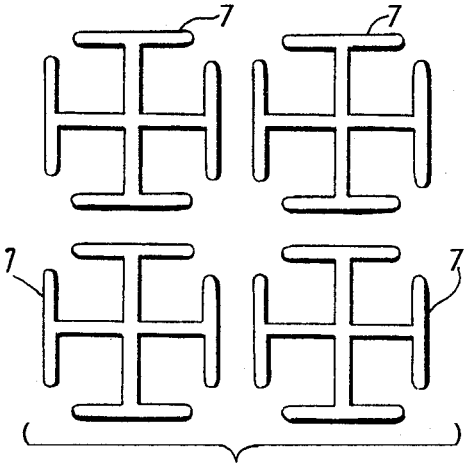
Figure 4C:
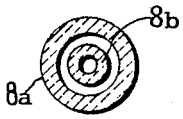
Figure 5:
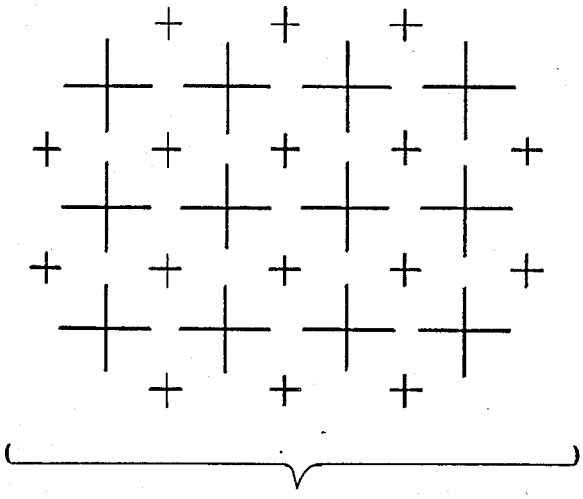
Figure 6:
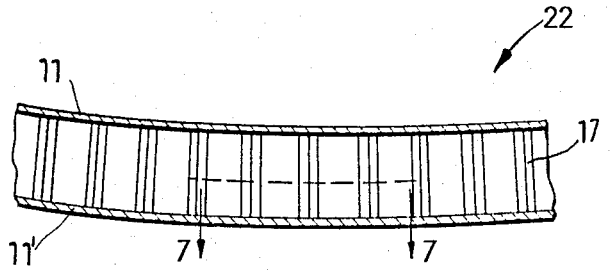
Figure 7:
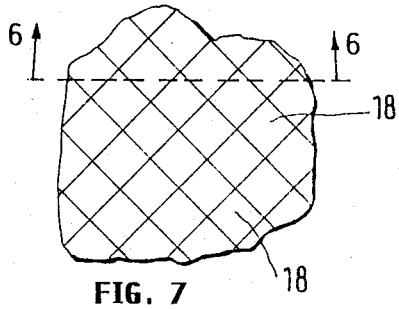

FIG. 3*a* shows a plan view of a reflector having a circular and an elliptical aperture, whereby the radius of the circular aperture corresponds to the length of the short half axis of the ellipsis;

FIG. 3*b* is a view similar to that shown in FIG. 3*a*, however with a circular and an elliptical aperture wherein the radius of the circular aperture is larger than the short half axis of the ellipsis;

FIG. 4*a* illustrates a group of antenna or reflector elements having a cross-shaped configuration;

FIG. 4*b* shows a group of antenna or reflector elements each having a Jerusalem cross-shaped configuration;

FIG. 4*c* shows an antenna or reflector element having a concentric circular configuration;

FIG. 5 illustrates schematically the arrangement of a plurality of antenna or reflector elements having cross-shaped configurations with two different dimensions of the crosses;

FIG. 6 illustrates a sectional view through a portion of a reflector wall constructed as a sandwich structure, whereby the section plane extends along section line 6—6 in FIG. 7;

FIG. 7 is a sectional view along section plane 7—7 in FIG. 6 illustrating a honeycomb type sandwich core structure with honeycomb cells having a square cross-sectional configuration; and FIG. 8 is a sectional view similar to that of FIG. 7, but showing honeycomb cells with a hexagonal, sectional configuration.

DETAILED DESCRIPTION OF PREFERRED EXAMPLE EMBODIMENTS AND OF THE BEST MODE OF THE INVENTION

FIG. 1 shows in dashed lines a side view of a portion 12 of a purely geometric paraboloid surface 10. A rigid reflector body 22 is shown in section in the lower left portion. The paraboloid surface 10 has an axis of symmetry 13 shown as a dashed line. An antenna feed horn 15 is operatively arranged at the focal point 14 of the surface 10. The feed horn 15 may be constructed for radiating two different frequency band widths or ranges. Two different aperatures or radiation lobe cross-sectional configurations 20 and 21 are provided for the two frequency ranges. The elliptical configuration 20 is provided for one frequency range and the circular configuration 21 is provided for the other frequency range. The surface of the respective actual reflector body 22 comprising the aperture configurations 20 and 21 forms a reflector of the geometric paraboloid surface 10. The reflector body 22 is located in an off-set type arrangement relative to the central symmetry axis 13 of the paraboloid surface 10. The respective reflector edge or margin 16 may be imagined to be obtained by intersecting the paraboloid surface of the portion 12 by a first cylinder 23 having a circular cross-section and by a second cylinder 24 having an elliptical cross-section. The two imaginary cylinders 23 and 24 are merely shown by dashed lines and their longitudinal axes extend in parallel to each other and in parallel to the symmetry axis 13. Thus, the two different cross-sectional areas partially overlap each other as illustrated in the top portion of FIG. 1 which is a view onto the reflector body 22 in the direction of the symmetry axis 13.

As a result of the partial mutual overlapping of the circular area 21 (surface zones A, B) with the elliptical area 20 (surface zones A, C, C) several surface zones are provided on the paraboloid surface of the reflector body 22. First, there is a first central surface zone A which is reflecting for both given frequency ranges or band widths $\Delta f_1$ and $\Delta f_2$. This central first surface zone A may be covered throughout its extent with a metal layer. Second surface zones B and C are also provided as shown. The zone B is reflecting for the frequency band width $\Delta f_1$ and it is transparent for the frequency band width $\Delta f_2$. On the other hand, the reverse is true for the surface zones C which are reflecting for the second band width $\Delta f_2$ and transparent for the first band width $\Delta f_1$. If the feed horn or antenna energizer 15 radiates only in the frequency range $\Delta f_1$, then only the surface zones A and B (circular area, are reflecting. On the other hand, when radiation in the frequency range $\Delta f_2$ is received, then the surface zones A and C (elliptical area) are reflecting. Metallic reflector or antenna elements to be described in more detail below, may be arranged in the surface zones B and C to form the reflector body 22. The reflecting components of the antenna are preferably made of copper. The surface areas which are reflecting for all given frequency ranges or band widths, generally the central surface zones are suitably provided with a continuous metal coating or with a surface of another material which is a good conductor of microwaves for example, carbon fiber reinforced synthetic material. However, with regard to the smallest wavelength to be handled by the antenna, it is possible to use a fine or narrow mesh metallic netting or grid structure.

FIG. 2 shows symbolically the plan view of a reflector which is, for example, paraboloid shaped having three areas 25, 26, and 27, but constructed in the same way as shown in FIG. 1 or having a reflector body or wall as shown in FIGS. 6, 7, and 8 to be described below. The reflector of FIG. 2 comprises, in addition to the two area configurations 25 and 27 corresponding to 20 and 21 shown in FIG. 1, the further circular area 26, whereby the area 26 is displaced to the right relative to the central elliptical area 25 while the area 27 is displaced to the left. The resulting surface zone D reflects only a third frequency band $\angle f_3$, but is transparent for the frequency bands $\angle f_1$ and $\angle f_2$. Further surface zones E and F result as shown in FIG. 2. These surface zones are selectively reflective for the frequency ranges $\angle f_1$ and $\angle f_2$ or for the frequency ranges $\angle f_2$ and $\angle f_3$. Thus, this embodiment comprises two circular areas 26 and 27 and the elliptical area 25 arranged in such a way that the circular area 27 is provided for the frequency band $\angle f_1$ while the elliptical area 25 is provided for the frequency range $\angle f_2$ and the circular area 26 is provided for the third frequency range $\angle f_3$.

As shown in FIGS. 3*a* and 3*b* a simple embodiment of an antenna according to the invention has one area with an elliptical configuration and another area with a circular configuration. In such a case, if the center points coincide and if the radius of the circle corresponds to the short half axis of the ellipsis, the result of the geometric overlapping of the areas is shown in FIG. 3*a* wherein a circular central reflector surface zone K reflecting both frequency ranges, is flanked above and below by two outer reflector surface zones L which are reflecting only in one frequency range, but which are transparent for the other frequency range. The outer surface zones L are located opposite each other, but are enclosed by the elliptical overall configuration. Thus, the resulting edge or margin contour of the reflector is elliptical.

FIG. 3*b* shows the configuration if the radius of the circular area is increased in size so that it becomes larger than the short elliptical half axis. In that case, two additional surface zones M project laterally outside of the contour of the ellipsis. These laterally projecting zones are transparent for the first frequency range and reflecting for the other frequency range of the two band widths involved. In the embodiment of FIG. 3*b* the marginal or edge contour is not strictly elliptical anymore.

If more than two frequency ranges are provided each having its own area, one obtains, due to the mutual overlapping of the areas a complicated subdivision of the entire reflector surface into surface zones which may comprise areas that selectively reflect in more than one frequency range and which are transparent for the remaining frequency range or ranges.

Thus, it will be seen from FIGS. 3*a* and 3*b* that the central zone K is reflective for two frequency ranges while the zones L are selectively reflecting only for one frequency range, whereas the zones M are selectively reflective for the respective other of the two given frequency ranges.

FIG. 4*a* shows four reflector elements 6, each having the same configuration, more specifically, that of a St. George cross. These reflector elements 6 are distributed over an antenna reflector surface zone for the frequency selective reflection or transparency to be described in more detail below. The elements 6 form cross-dipoles. FIG. 4*b* shows four reflector elements 7 having a Jerusalem cross type configuration. These elements 6; 7 are arranged in a regular pattern as shown. FIG. 4*c* shows a reflector element comprising two concentric rings 8*a* and 8*b*. The dimension of these antenna elements 6, 7, 8*a*, 8*b* will depend on the particular given frequency range to be selectively reflected by these antenna elements.

FIG. 5 illustrates schematically how two cross-type dipoles of different sizes are arranged in two arrays which are nested one in the other so to speak, to be selectively reflective for two different frequency ranges. Although two cross-type element configurations are shown in FIG. 5, the individual elements may also have different configurations, for example, cross-type and concentric ring type reflector elements may be arranged in a regular nesting pattern as symbolically illustrated in FIG. 5.

As mentioned, the reflecting metallic surface layers or the reflector elements are made primarily of copper since this metal is especially well suited for applying the respective layers by using printed circuit techniques.

FIG. 6 shows on an enlarged scale as compared to FIG. 1, a sectional view of a portion of the single concave reflector body 22 comprising a dielectric sandwich structure including a honeycomb type core 17 and two cover layers 11 and 11'. The honeycomb core may be constructed of hard paper which results in an extraordinary bending stiffness. The cover layers 11 and 11' may be made, for example, of a synthetic material reinforced by aramide fibers. This type of structure is very light and yet has a substantial mechanical stability including a shape and dimensional stability. As shown in FIG. 7 the individual honeycomb cells 18 may have a square cross-sectional configuration. FIG. 8 shows that the individual cells 18' may have, for example, a hexagonal configuration.

By the way, for producing the above described arrays of regular antenna or reflector elements it is possible to use any conventional thin layer techniques, including printed circuit techniques. Masking and etching techniques are suitable for the present purposes. The masking and etching techniques involve applying as a first coating, a continuous metallic layer on the cover layer 11 as shown in FIG. 6, for example, by a vapor deposition technique. The so deposited continuous metallic layer is then covered with suitable masking elements whereupon the etching step is performed to leave, for example, a pattern or arrays of dipoles as shown in FIG. 5.

Yet another possibility to provide the surface zones which are reflecting for one frequency range and transparent for another frequency range comprises to provide a honeycomb structure of metal which is open on both surfaces. The individual cells of the honeycomb structure may have a square or a hexagonal cross-sectional configuration. Each individual cell forms a section of a wave guide element. In this type of structure it is necessary that the cut-off frequency of the wave guide sections is located between the two given frequency ranges. Such a structure formed by wave guide sections or elements is transparent above the wave guide cut-off frequency and reflecting below the wave guide cut-off frequency.

Another possibility of providing the reflector with frequency selective surface zones involves cutting a plurality of holes into an initially continuous metallic layer, whereby the holes are arranged in a uniform pattern. The holes are dimensioned with due regard to a determined narrow frequency range so that the holes are tuned and hence transparent to this frequency range. All other frequencies are reflected so that such a structure is suitable for use in connection with two given frequency ranges or band widths. As mentioned above, the holes can have the shape of cross-dipoles or Jerusalem crosses and they may be formed, for example, by die-stamping or by etching techniques or the like.

As described with reference to FIG. 6, the mentioned metallic surface layers or reflector or antenna elements are applied on a dielectric base structure which forms the reflector body 22 proper. The surface of the reflector body facing in the direction of the radiation is covered with the metal layer or with the reflector elements which thus assume the curvature of the body which preferably has a paraboloid shape as mentioned. Incidentally, the honeycomb type core 17 may for example, be made of a hard paper sold under the trade name "Nomex" by the DuPont Company of Wilmington, Delaware. Instead of a honeycomb structure the core 17 may be made of hard foam, for example on the basis of polyurethane, an acrylic resin, or polymethacrylimide. The dielectric cover layers 11 may be made of fiber reinforced synthetic material such as a resin having aramide fibers embedded therein. It is a special advantage of the invention that it is now possible to use but one antenna where it was necessary heretofore to use two or more antenna reflectors. Especially in connection with satellite antennas this advantage is important because it results in a substantial space and weight reduction. For example, the satellite known as "TV-SAT" comprises two off-set parabolic antennas each having a focal width of 1.5 m. The transmitter antenna intended for transmitting in the first frequency range $\Delta f_1$ corresponding to 11.7 to 12.1 GHz, has an elliptical aperture with a short axis of 1.4 m and a long axis of 2.7 m. The receiver antenna intended for receiving in the frequency range $\Delta f_2$ equal to 17.7 to 18.1 GHz has a circular aperture with a diameter of 2 m. According to the invention these two apertures can now be embodied by a single antenna reflector according to the invention as shown in Fig 1, whereby substantial weight and space savings have been achieved.

Although the invention has been described with reference to specific example embodiments, it will be appreciated, that it is intended to cover all modifications and equivalents within the scope of the appended claims.

What is claimed is:

1. A reflector antenna for operation in more frequency bands than one frequency band, comprising a single rigid concave reflector body having a reflector surface and at least one antenna feed horn element for illuminating said reflector surface for radiating in said frequency bands, said reflector surface itself being subdivided into a plurality of different reflector areas partially overlapping each other for forming a number of separate reflector surface zones, first means for making at least one first surface zone of said reflector surface zones reflective in all of said frequency bands, and further means for making at least one second reflector surface zone reflective in at least one of said frequency bands and simultaneously transparent for any other of said frequency bands, so that said reflector surface zones have different frequency response characteristics in accordance with said different frequency bands, said single rigid reflector body having a margin contour which is defined by respective portions of outermost margin lines of said surface zones as a result of said partial overlapping of said different reflector areas.

2. The reflector antenna of claim 1, wherein said at least one first surface zone, which reflects in all of said frequency bands, comprises a first reflector element in the form of a metal layer which is metallic throughout, and wherein said at least one second surface zone comprises a plurality of metallic second reflector elements tuned to the respective frequency band, said second reflector element covering the respective reflector surface zone of the concave reflector in a uniform surface pattern.

3. The reflector of claim 2, wherein said single concave reflector body is made of a dielectric material, said single concave reflector body having said reflector surface formed by said metal layer forming said first surface zone and by said uniform surface pattern of said second reflector elements which have been formed on said metal layer by masking and etching techniques.

4. The reflector antenna of claim 1, wherein said at least one second surface zone is reflective in several of said frequency bands, but being transparent for any remaining frequency bands, and wherein said second surface zone comprises pluralities of reflector elements, each plurality of reflector elements being tuned to a different one of said several frequency bands, said reflector elements covering said second surface zone of the single concave reflector body in uniformly nested surface patterns.

5. The reflector of claim 4, wherein said single concave reflector body is made of a dielectric material, said single concave reflector body having said reflector surface formed by a metal layer covering said first surface zone and by uniformly nested surface patterns of said reflector elements having been formed on said metal layer by masking etching techniques.

6. The reflector antenna of claim 1, for operation in two frequency bands, wherein said first surface zone comprises a continuous metallic layer on said reflector surface and wherein said second surface zone comprises holes in said metallic layer, said holes being arranged in a uniform surface pattern, said holes being tuned to one of said frequency bands, whereby said pattern is transparent to said one frequency band.

7. The reflector antenna of claim 1, for operation in two frequency bands including a lower and a higher frequency band, wherein said single concave reflector body comprises a plurality of adjacent wave guide elements made of metal and assembled in a honeycomb type structure which is open on both sides, said honeycomb type structure forming a reflector zone which is reflective for said lower frequency band and transparent for said higher frequency band.

8. The reflector of claim l, wherein said single concave reflector body is made of dielectric material, metallic coating means on said single concave reflector body forming a first reflector element for one frequency band and second reflector elements for another frequency band applied to said single concave reflector body made of dielectric material.

9. The reflector antenna of claim 8, wherein said single concave reflector body of mode dielectric material comprises a sandwich structure including a core and dielectric material cover layer on said core.

10. The reflector antenna of claim 9, wherein said core comprises a hard foam core, said dielectric material cover layers covering said hard foam core.

11. The reflector antenna of claim 9, wherein said core comprises a honeycomb type core, said dielectric material cover layers covering said honeycomb type core.

12. The reflector antenna of claim 9, wherein said dielectric material cover layers are made of fiber reinforced synthetic material.

13. The reflector antenna of claim 12, wherein said fiber reinforced synthetic material comprises aramide fibers.

* * * * *

UNITED STATES PATENT AND TRADEMARK OFFICE

CERTIFICATE OF CORRECTION

PATENT NO. : 4,851,858

DATED : July 25, 1989

INVENTOR(S) : Eberhard Frisch

It is certified that error appears in the above-identified patent and that said Letters Patent is hereby corrected as shown below:

Claim 2, line 8, (column 7, line 45), replace "element" by -- elements--;

Claim 5, line 7, (column 8, line 14), after "masking" insert --and--;

Claim 9, line 2, (column 8, line 41), replace "of mode" by --made of--;

Claim 9, line 4, (column 8, line 43), replace "layer" by --layers--.

Signed and Sealed this

Fifteenth Day of May, 1990

*Attest:*

HARRY F. MANBECK, JR.

*Attesting Officer*

*Commissioner of Patents and Trademarks*